United States Patent [19]

Besser et al.

[11] 4,037,912

[45] July 26, 1977

[54] TERMINAL ASSEMBLY

[75] Inventors: Helmut Siegfried Besser, Williston, Vt.; Günter Kieven, Bodenheim; Jürgen Wettlauffer, Mainz, both of Germany

[73] Assignee: International Business Machines Corporation, Armonk, N.Y.

[21] Appl. No.: 688,654

[22] Filed: May 21, 1976

[30] Foreign Application Priority Data

May 24, 1975 Germany ..... 2523164

[51] Int. Cl.[2] ..... H01R 9/18

[52] U.S. Cl. ..... 339/198 R; 339/221 R

[58] Field of Search ..... 339/198 R, 198 G, 198 GA, 339/198 H, 198 J, 198 P, 198 S, 198 N, 205, 221 R, 221 M, 256 SP, 258 S

[56] References Cited

U.S. PATENT DOCUMENTS

| | | | |
|---|---|---|---|
| 3,315,219 | 4/1967 | Brinser | 339/198 R |
| 3,377,614 | 4/1968 | Powell | 339/198 GA |
| 3,456,231 | 7/1969 | Paullus | 339/198 GA |
| R27,429 | 7/1972 | Gilissen | 339/198 |

*Primary Examiner*—Roy Lake
*Assistant Examiner*—Mark S. Bicks
*Attorney, Agent, or Firm*—Henry Powers

[57] ABSTRACT

Disclosed is a terminal assembly comprising a housing composed of an insulating material and having spaced apart wall members projecting from a base plate and defining a chamber. A conductive strip having projecting terminals thereon is snapped into the chamber and is rigidly held therein by protrusions extending from the wall members.

7 Claims, 2 Drawing Figures

TERMINAL ASSEMBLY

SUMMARY OF THE INVENTION AND STATE OF THE PRIOR ART

Figure 1:
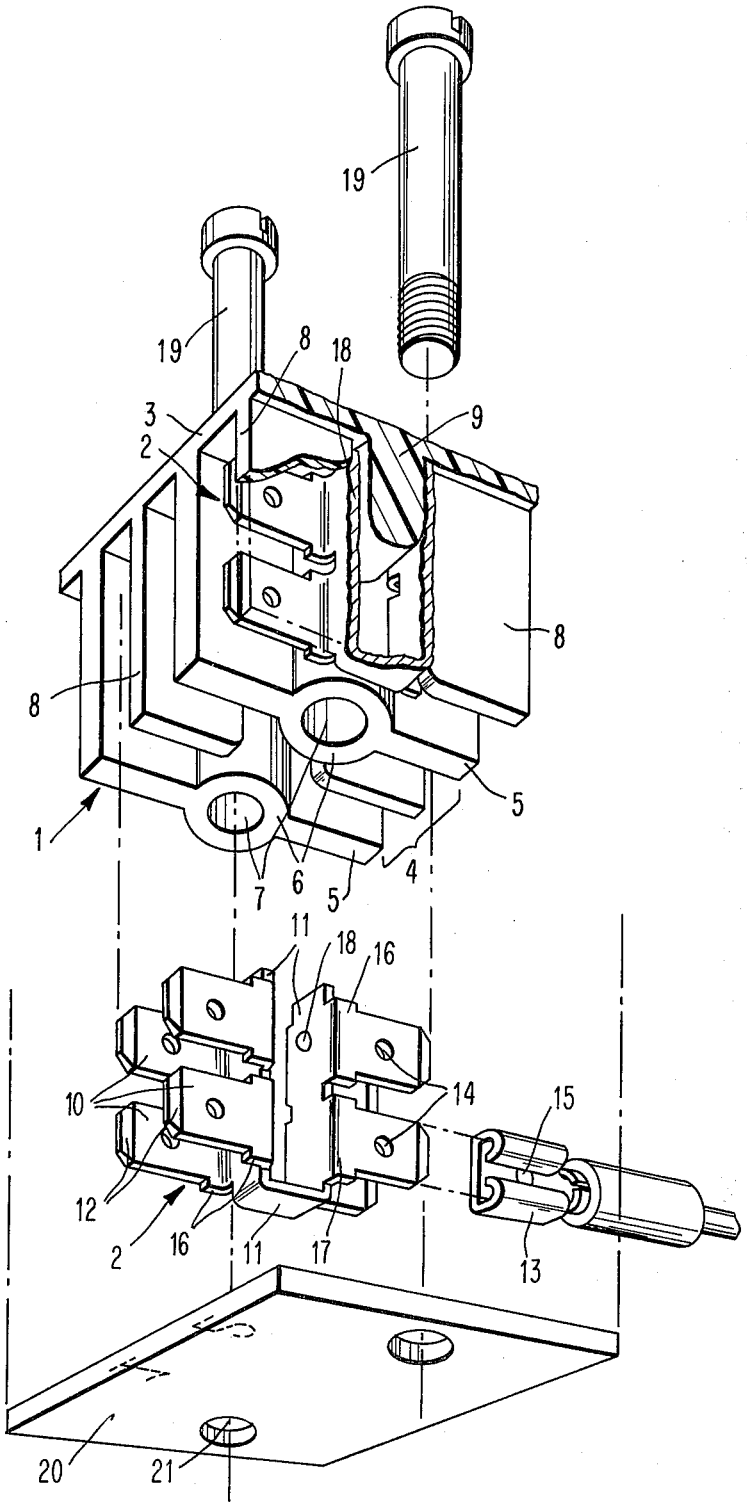

The present invention relates to a terminal assembly and more particularly relates to a terminal assembly which comprises an insulated housing divided into at least one chamber and into which a connector member is rigidly held therein.

German Offlegungsschrift 14 65 192 describes terminal assemblies where contact type connections are installed in the chambers of insulated housings. For setting up these terminal assemblies the contact connections have to be inserted into the chambers of a first housing half, and after the application of a second housing half both halves have to be fixedly connected. A disadvantage of these known terminal assemblies is that for their assembling three operational steps are involved, i.e. inserting the connections, applying the second housing half, and connecting both housing parts. Moreover, the terminal's are loosely held in the housing, which is disadvantageous in the plugging-in of electric connections.

This latter disadvantage is avoided in a terminal assembly which is described in German Auslegeschrift 19 39 722. In this terminal assembly, receptacle-like connections are inserted in several borings of an insulating block. Subsequently, the entire terminal assembly is heated so that the block which is composed of a synthetic material, shrinks under the influence of heat in such a manner that the contact connections are firmly embedded in the synthetic material block. Although for making this terminal assembly only two operational steps are involved, the heating of the housing block is relatively complicated, and upon the insertion of the terminals and during the heat shrinking process considerable dimensional inaccuracy may occur.

Another kind of terminal assembly is described in German Offenlegungsschrift 22 04 555. Here too the housing comprises individual chambers. On the plug-in side for the terminals the chambers are equipped with protruding locking walls. The electric terminals are made of resilient material and have resilient elements projecting from the longitudinal direction of the terminals. During mounting, i.e., upon the insertion of the terminals into the chambers, the resilient elements place themselves against the terminals, and as soon as the terminals have fully entered the chambers the ends of the resilient elements expand and support themselves against the locking walls so that the terminals can no longer be removed from the chamber. These terminals can be installed in the housing in only one operational step, but they are not immovably fixed in the housing. Additionally, the terminals have to be of a resilient material and like the chambers of the housing they are of a relatively complicated form.

Another type of terminal assembly known in numerous variations is described, for example, in U.S. Pat. No. 2,925,577. In these known terminal assemblies, the electric terminals have additional leaves which after insertion into the housing are bent in such a manner that they support themselves against corresponding protrusions or recesses in the insulating housing. Here also two operational steps are required for the mounting of the electric connections, i.e., insertion and bending of the leaves. These leaves do not ensure a rocking-free fitting of the connector in the chambers of the housing.

In view of the above, it is a principal object of the present invention to provide a terminal assembly wherein the connector member may be inserted into the chambers of the housing in one single operational step by means of simply pushing them in, the electrical connector member as well as the chambers being designed in such a manner that the contacting connections are immovably fixed in the housing chambers.

Figure 2:
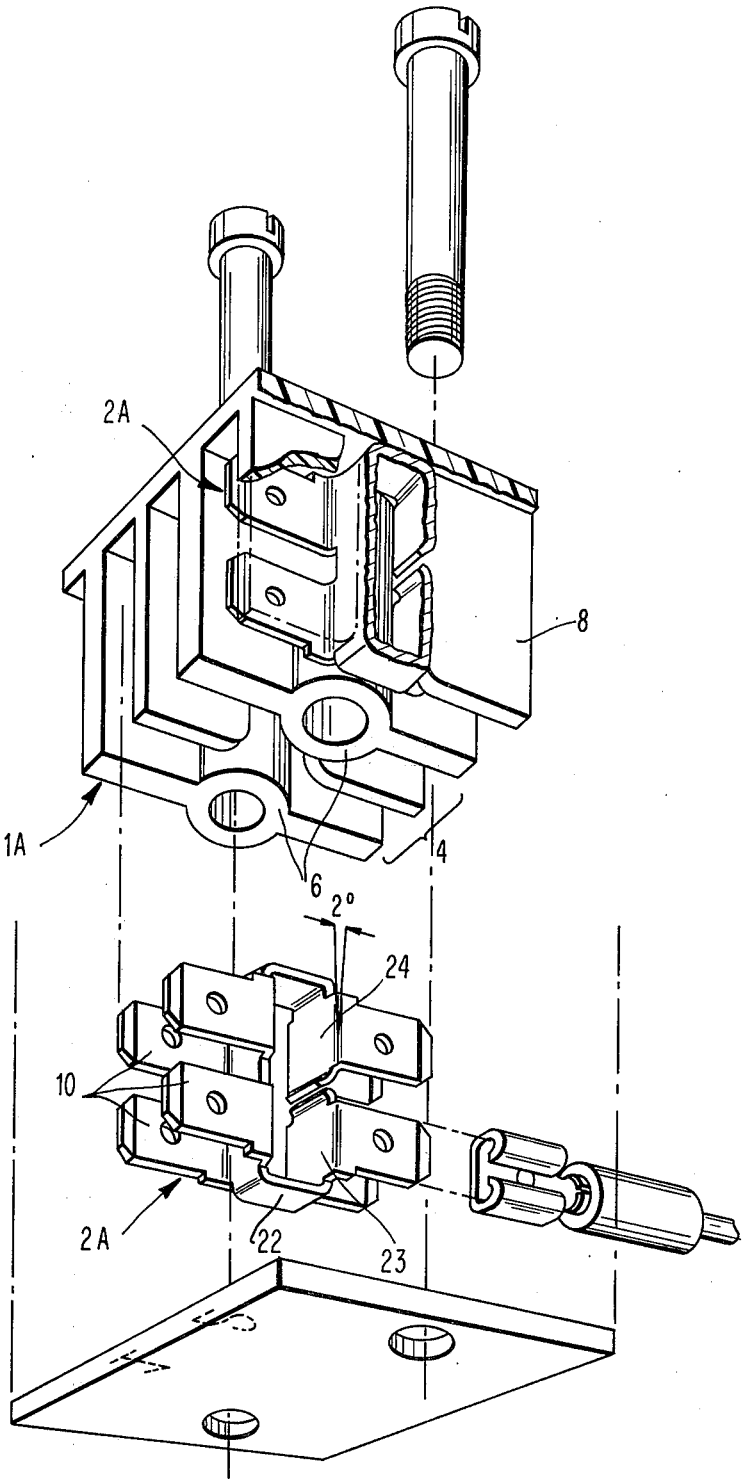

Other objects and a more complete understanding of the invention may be had by referring to the following specification and claims taken in conjunction with the accompanying drawings in which:

FIG. 1 is an exploded fragmentary perspective view of a terminal assembly constructed in accordance with the present invention; and FIG. 2 is an exploded fragmentary perspective view of another embodiment of a terminal assembly constructed in accordance with the present invention.

Referring now to the drawings, the terminal assembly shown in FIG. 1 generally comprises a housing 1 and a connector member 2. Housing 1 is composed of an insulating material, preferably a synthetic material such as e.g. polycarbonate, polyester, or polystyrene. Housing 1 is held together by a base plate 3 onto which all individual parts are fixed. To all three other sides housing 1 is open. A chamber 4 is formed by spaced apart wall members 5 projecting from the base plate 3. In the middle of the chamber walls there are abutments, in the present instance, columns 6, the reasons for which will be described below. As shown, the columns include a bore 7 which extends through base plate 3. In the embodiment of FIG. 1, chambers 4 are divided into equal parts by a bifurcated divisional wall member 8, the confronting end portions of the bifurcated wall confronting one another in spaced apart relation. In the longitudinal direction of the terminal assembly, intermediate the walls 5, is a longitudinal extending rib 9.

The connector member 2 comprises a plurality of terminals or flat tabs 10 which are connected to each other by a conductive strip 11. In the direction of its narrow side, conductive strip 11 is bent into a "U" forming upstanding, spaced apart leg portions joined by a bottom portion. The terminals 10 are arranged in pairs and are connected to opposite longitudinal edges of the conductive strip and are bent outwardly so as to be substantially perpendicular thereto. The bend is in such a manner that the terminals in the transverse direction of the metal strip 11 in the leg portion, also form a "U". The connector member comprising conductive strip 11 and terminals 10 are preferably punched out of a sheet metal. A material suitable for the connectors is e.g., brass, copper, or bronze. For better contacting properties, the terminals can be plated e.g., with tin or a tin alloy. Terminals 10 are preferably pointed at their terminal ends 12 in order to facilitate the plugging-on of flat receptacles 13. In the middle of their surface, each of the flat tabs 10 include an aperture 14 which coacts with a boss-like protrusion 15 in flat receptacle 13 in order to secure the flat receptacle on the flat tab 10. For limiting the plug-in depth of the flat receptacles 13, each of the flat tabs 10 has shoulders 16 at its inner end.

For mounting connector members 2 in housing 1, the members 2, as shown in FIG. 1, are inserted in the selected chamber 4 from below the insulated housing. In the present embodiment, flat tabs 10 are connected via a laterally projecting offset 17 to the longitudinal edges of the U-shaped conductive strip 11. The offsets 17 are spaced apart a sufficient distance that they are forced against the abutments or columns 6 locking the connector member thereto thereby giving the connector member in chamber 4 a firm and immovable lodgment. Front chamber 4 of FIG. 1 is represented in a sectional view and illustrates how offset 17 of the terminals 10 rest against column 6.

This front chamber shows the separation of the individual terminals 10 by divisional wall 8. Divisional wall 8 forms a guiding element for flat receptacles 13 and act as a safety feature by preventing the touching of the terminals 10 with the hand. Boss-like protrusions 18 on the inside of the conductive strip 11 coact with the longitudinal extending rib 9 and improve the fitting of the terminals in chambers 4 of insulating housing 1.

Via screws 19 inserted into columns 6 through bores 7 the terminal assembly can be connected to an instrument wall. Between the lower side of housing 1 and the instrument wall to which the terminal assembly is to be attached, an insulation board 20 with apertures 21 may be inserted. Insulation board 20 may illustrate terminal connections for chambers 4 thereabove. The terminal assembly can, of course, also be clamped or glued to the device.

Another embodiment of a terminal assembly constructed in accordance with the invention is shown by FIG. 2. As the embodiments of FIGS. 1 and 2 correspond in many details the following description discusses only those parts of FIG. 2 which differ from FIG. 1.

In housing 1A, longitudinal rib 9 is no longer provided. In the connector member 2A, a conductive strip 22 connecting flat tabs or terminals 10 is bent into a double "U", two aligned legs of the two "U's" being interconnected, the other two legs 23 and 24 of the two "U's" having spaced apart terminal ends which are outwardly biased and under tension, so that the two legs 22 and 23, when the tension is released, are inclined by 4° with respect to each other, i.e. that they are outwardly inclined by 2° from a vertical plane. In the embodiment of FIG. 2, the two open legs of metal strip 22 are bent outward in their relaxed position so that upon the insertion of the connector member 2 into chambers 4 of housing 1A, they are biased against the end portions of the bifurcated divisional wall 8 into a position which is parallel to the other two legs, thus maintaining the connector member 2A absolutely firmly in chambers 4. The non-connected legs of conductive strip 22 could also exhibit such an initial tension that with the tension being released they would project inward. In that case, open legs 23 and 24 of the double - "U"-shaped metal strip 22 will support themselves against the lateral area of cylindrical columns 6.

The terminals do not have to be designed as flat tabs; they may take the form of flat receptacles, or they may also be cylindrical pins or pin receptacles.

Instead of eight terminals, a connector member 2, 2A could also show a higher or lower number of terminals. It is, however, important that the terminal contains a substantially U-shaped conductive strip which can lock against cylindrical columns 6 of housing 1, 1A. Additionally, the terminal assemblies shown in FIGS. 1 and 2 may be extended by additional chambers.

While the invention has been described and shown particularly with reference to one of its preferred embodiments, it will be understood by those skilled in the art to which the work is directed that various changes in form and detail may be made without departing from either the spirit or scope of the invention.

We claim:

1. A terminal assembly comprising a housing composed of a rigid insulating material, said housing including spaced apart wall members projecting from a base plate and defining a chamber therebetween; an elongated protuberance on each of said wall members in coextension with the extension thereof and projecting inwardly into said chamber; a U-shaped connector member for insertion into said chamber, said connector member formed from a strip of conductive material and having upstanding, spaced apart leg portions joined by a bottom portion; oppositely directed terminals formed from U-shaped segments of said leg portions in projection therefrom, with said terminals having common directional projections on each common leg portion, and with the terminals on one leg portion having an oppositely directed projection relative to that of the terminals on the other of said leg members, and means on said conductive strip for providing locking engagement with said abutments when said connector member is inserted into said chamber whereby said connector member is fixedly secured in said chamber.

2. A terminal assembly in accordance with claim 1 wherein said terminals are connected in pairs to opposite longitudinal edges of said conductive strip forming a U substantially perpendicular to the leg portions of said strip.

3. A terminal assembly in accordance with claim 1 including a bifurcated divisional wall member projecting from said base plate into said chamber and dividing said chamber, said divisional wall member having wall portions spaced one from the other parallel with and intermediate first said wall members, said wall portions sheathed within a corresponding space defined by said connector leg portions and their associated terminals, said conductive leg portions having a sufficient width therebetween to bear against opposed edge portions of said wall portions.

4. A terminal assembly in accordance with claim 3 wherein said terminals are arranged in pairs, each terminal of a pair being positioned on opposite sides of said divisional wall member.

5. A terminal assembly in accordance with claim 1 including a rib on said base plate extending through said chamber, said rib having a width dimension to permit embracing thereof between extended end portions of said leg portions of said conductive strip intermediate said wall members.

6. A terminal assembly in accordance with claim 5 including inwardly projecting protrusions on said leg portions of said conductive strip for coaction with said rib.

7. A terminal assembly comprising a housing composed of an insulating material, said housing including spaced apart wall members projecting from a base plate and defining a chamber therebetween; an abutment in each of said wall members projecting inwardly into said chamber; a connector member for insertion into said chamber, said connector member comprising a strip of conductive material having upstanding, spaced apart leg portions joined by a bottom portion; terminals integrally connected to said leg portions and projecting substantially perpendicular thereto, and means on said conductive strip for providing locking engagement with said abutments when said connector member is inserted into said chamber whereby said connector member is fixedly secured in said chamber; and a bifurcated divisional wall member projecting from said base plate into said chamber and dividing said chamber, said divisional wall member having end portions spaced one from the other, said conductive strip having a width sufficient to bear against the end portions of said wall member, wherein said conductive strip is bent into the shape of a double U with the open portion of said U's facing each other, two aligned leg portions of said double U being integrally joined and the other of said leg portions having terminal ends spaced from each other, each of said unjoined legs being biased outwardly against one end portion of said bifurcated divisional wall member to thereby aid in retaining said connector member immovably mounted in said chamber.

* * * * *